United States Patent [19]

Wellman

[11] Patent Number: 4,530,175

[45] Date of Patent: Jul. 23, 1985

[54] PORTABLE, WEATHERTIGHT DOCUMENT STORAGE AND VISIBLE DISPLAY DEVICE

[76] Inventor: Brian Wellman, 2247½ N. Shore Rd., Bellingham, Wash. 98226

[21] Appl. No.: 519,020

[22] Filed: Aug. 1, 1983

[51] Int. Cl.[3] ..... G09F 3/18

[52] U.S. Cl. ..... 40/10 B; 40/530; 150/52 R

[58] Field of Search ..... 40/10, 10 B, 10 C, 159; 150/52

[56] References Cited

U.S. PATENT DOCUMENTS

| | | | |
|---|---|---|---|
| 596,300 | 12/1897 | Lee | 150/52 R |
| 1,712,088 | 5/1929 | Mellin | 40/10 B |
| 1,836,154 | 12/1931 | Cobbs | 40/10 B |
| 2,293,979 | 8/1942 | Hopkins | 150/52 R |

FOREIGN PATENT DOCUMENTS

| | | | |
|---|---|---|---|
| 1141803 | 2/1969 | United Kingdom | 150/52 R |

*Primary Examiner*—Gene Mancene
*Assistant Examiner*—Wenceslao J. Contreras
*Attorney, Agent, or Firm*—Hughes, Barnard & Cassidy

[57] ABSTRACT

A portable, weathertight document storage and visible display device (10) including n, where "n" is preferably "2" or more, liquid impervious envelopes ($22_a$–$22_n$) formed of transparent flexible synthetic sheet material for readily displaying both the front and back face of a single document (25) or the exposed faces of two documents (25) disposed in back-to-back relation when the storage and display device (10) is unrolled and wherein the individual envelope(s) ($22_a$–$22_n$) may be overturned and/or reordered in position so as to expose either face of any given envelope ($22_a$–$22_n$) without breaching the watertight integrity thereof; and, wherein the entire assemblage can be compactly and tightly rolled into a tubular helix and stored or transported to a point of use. The storage and display device (10) in the illustrative form of the invention includes a fabric backing member (11) having a series of male or female fabric fastening elements (29) disposed along one edge thereof, an integral fabric flap (26) having a series of cooperable female or male fabric fasteners (28) disposed on the undersurface thereof and positioned to overlie the fasteners (29) on backing member (11); while each of the envelopes(s) ($22_a$–$22_n$) includes a linear array of mating male or female fabric fasteners (30) disposed on the undersurface of the envelope along one edge thereof and a series of mating female or male fabric fasteners (31) disposed on the upper surface of each envelope along the same edge thereof so as to fixedly, but removably, retain the envelope(s) ($22_a$–$22_n$) on the fabric backing member (11) with freedom to be overturned about their fastened connection (28–31) thereto to expose the reverse side of the overturned envelope and the front face of the underlying envelope. Each envelope ($22_a$–$22_n$) is provided with a resealable access opening (24) to permit introduction of documents into and/or removal of documents from the respective envelopes.

11 Claims, 4 Drawing Figures

PORTABLE, WEATHERTIGHT DOCUMENT STORAGE AND VISIBLE DISPLAY DEVICE

TECHNICAL FIELD

The present invention relates generally to document storage and display devices; and, more particularly to a weathertight storage and display device suitable for use at field construction sites, on marine vessels, and in other locations where the user has a need to refer from time to time to construction blueprints, marine charts, and similar paper documents under a wide variety of inclement and/or other adverse environmental conditions. More specifically, the present invention is concerned with a portable, rollable and unrollable storage/-display device for documents of the foregoing type having at least one, and generally a plurality, of document protective envelopes formed of transparent liquid impervious synthetic material mounted on a fabric-like backing member formed of tarpaulin or the like and wherein each envelope includes a resealable access opening along one edge thereof for permitting introduction of documents into and/or removal of documents from the interior of the envelope and selective retention of such documents therein in a protected weathertight condition; yet, where the face of each document stored is visible through the protective transparent envelope, and wherein, when not in use, the document containing envelope(s) can be rolled up with the fabric backing member for compact storage and protection from rain, dirt and other environmental contaminants, while when in use, the envelope(s) and the fabric backing member can be unrolled and displayed in a planar condition with freedom to overturn the uppermost envelope(s) for purposes of exposing documents through either the back of any given envelope or through the front of an underlying envelope.

BACKGROUND ART

For many years, architects, construction workers, boaters and similar personnel have had a need for an effective lightweight, portable storage/display device for use in protecting construction drawings, marine charts and the like from adverse weather and environmental conditions while, at the same time, permitting both: (i) ease of reference to such documents when needed without exposure to the elements; and (ii), compact protected storage thereof when not in use. Many approaches have heretofore been suggested in an effort to solve this problem; but, despite these efforts, prior to the advent of the present invention no simple, effective storage/display device has found widespread acceptance. For example, a very early approach is that disclosed in U.S. Pat. No. 596,300—Lee, wherein the patentee provides an envelope formed of a cardboard stiffened, rubber-coated, nonrollable backing member and a transparent face formed of celluloid with the two envelope defining components being rollable along one edge so as to seal the access opening while permitting reference to the chart or other document contained within the envelope through the celluloid face.

In U.S. Pat. No. 2,293,979—Hopkins, the patentee discloses a portable map case having a flexible waterproof sheath formed of leather or the like and which is capable of being rolled into and from a tubular configuration with the device having a pair of transparent sheets carried therein which permit of placement of a map, with or without a superimposed sheet of tracing paper, therebetween. As in the aforesaid Lee patent, the device is intended to display only a single document at a time.

Corley U.S. Pat. No. 2,346,908 discloses a flexible roll-up drawing board comprising a relatively complex construction including a plurality of rigid slats secured to a canvas backing member and a transparent sheet of flexible material removably secured thereto by a circumferential zipper mechanism. In a subsequently issued patent—viz., U.S. Pat. No. 2,661,570—Corley discloses a modified version of a roll-up map case in which the zipper is deployed along one edge only of the transparent envelope defining sheet, with the remaining edges being permanently secured to the flexible canvas backing and rigid slat arrangement.

In U.S. Pat. Nos. 2,294,276—Callinicos and 4,157,626—Bedinghaus, the patentees disclose rather rigid plate-like display devices having transparent faces for protecting maps, charts and the like. In the Bedinghaus patent, the chart may be off-rolled from a roll adjacent one edge of the device and simultaneously on-rolled about a second parallel roll at the opposite edge of the device, thereby permitting inspection of a selected region of a relatively long, continuous document having a length considerably greater than the width of the transparent holding device.

Other prior patents of general interest include U.S. Pat. No. 1,623,806—Nienhauser pertaining to a roll-up tissue paper package; and, U.S. Pat. No. 3,270,791—Harris relating to a roll-up fabric storage device.

However, notwithstanding the foregoing prior disclosures, there has been no simple, effective storage/-display device characterized by its ability to maintain a plurality of documents in a sealed weathertight environment at all times, yet wherein any given document may be immediately and fully displayed while being maintained in a weathertight environment; and, wherein the entire package can be rolled into a tight, compact, tubular helix for ease of portability and/or compact storage when not in use.

SUMMARY OF THE INVENTION

A portable, weathertight document storage and visible display device including n, where "n" is preferably "2" or more, liquid impervious envelopes formed of transparent flexible synthetic sheet material for readily displaying both the front and back face of a single document or the exposed faces of two documents disposed in back-to-back relation when the storage and display device is unrolled and wherein the individual envelope(s) may be overturned and/or reordered in position so as to expose either face of any given envelope without breaching the watertight integrity thereof; yet, when not in use, the entire assemblage can be compactly and tightly rolled into a tubular helix and stored or transported to a point of use. The storage and display device of the present invention readily permits of hanging or suspension from a vertically oriented work surface and/or display on a table; and, permits the use of grease pencils or the like to provide erasable annotations over the exterior of the individual transparent weathertight envelope(s) as, for example, might be desired when modifying or emphasizing construction details on a blueprint at a construction site or when charting a navigational course on a marine vessel. The portable storage and display device is characterized by the complete absence of any complex or movable parts; yet, the order of a plurality of envelopes can be quickly changed while allowing each envelope to remain securely attached to one another and to the flexible fabric backing member.

It is a general aim of the present invention to provide an improved portable, weathertight storage and visible display device for containing blueprints, marine charts and the like characterized by its simplicity, effectiveness, reliability in use and its ability to be formed of readily available materials; yet, which is highly versatile and permits either storage or virtually instantaneous display of any given one of a plurality of documents which are totally enclosed and protected from the environment.

A more detailed object of the invention is the provision of a storage and display device of the foregoing character which can be easily rolled into a compact tubular helix for ease of storage and/or portability, while permitting of retention and selective display of a plurality of protected documents, and which is totally devoid of moving parts and/or components likely to be damaged by adverse weather and/or environmental conditions.

DESCRIPTION OF THE DRAWINGS

These and other objects and advantages of the present invention will become more readily apparent upon reading the following detailed description and upon reference to the attached drawings, in which.

Figure 1:
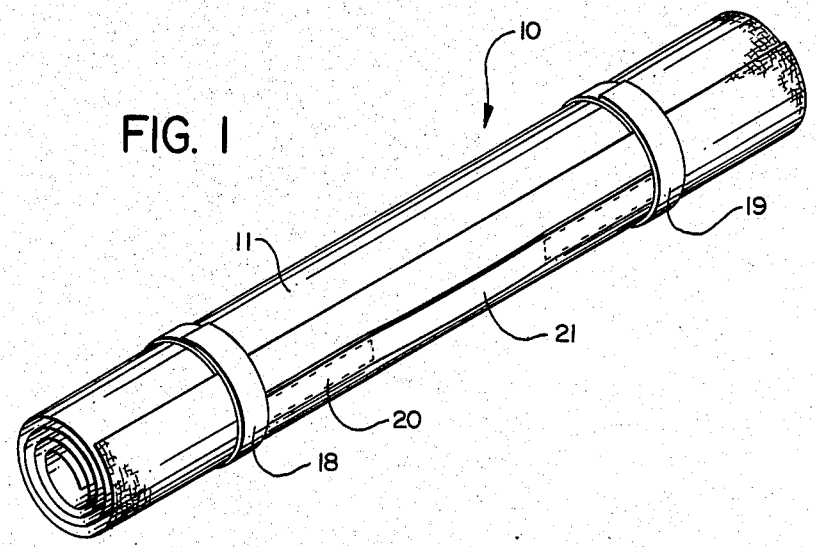
FIG. 1 is a perspective view of a storage device for construction drawings, charts and the like embodying the features of the present invention and here illustrating the storage device rolled up in a tight tubular helix for ease of portability and compact storage.

While the invention is susceptible of various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents, and alternatives falling within the spirit and scope of the invention as expressed in the appended claims.

DETAILED DESCRIPTION

Figure 2:
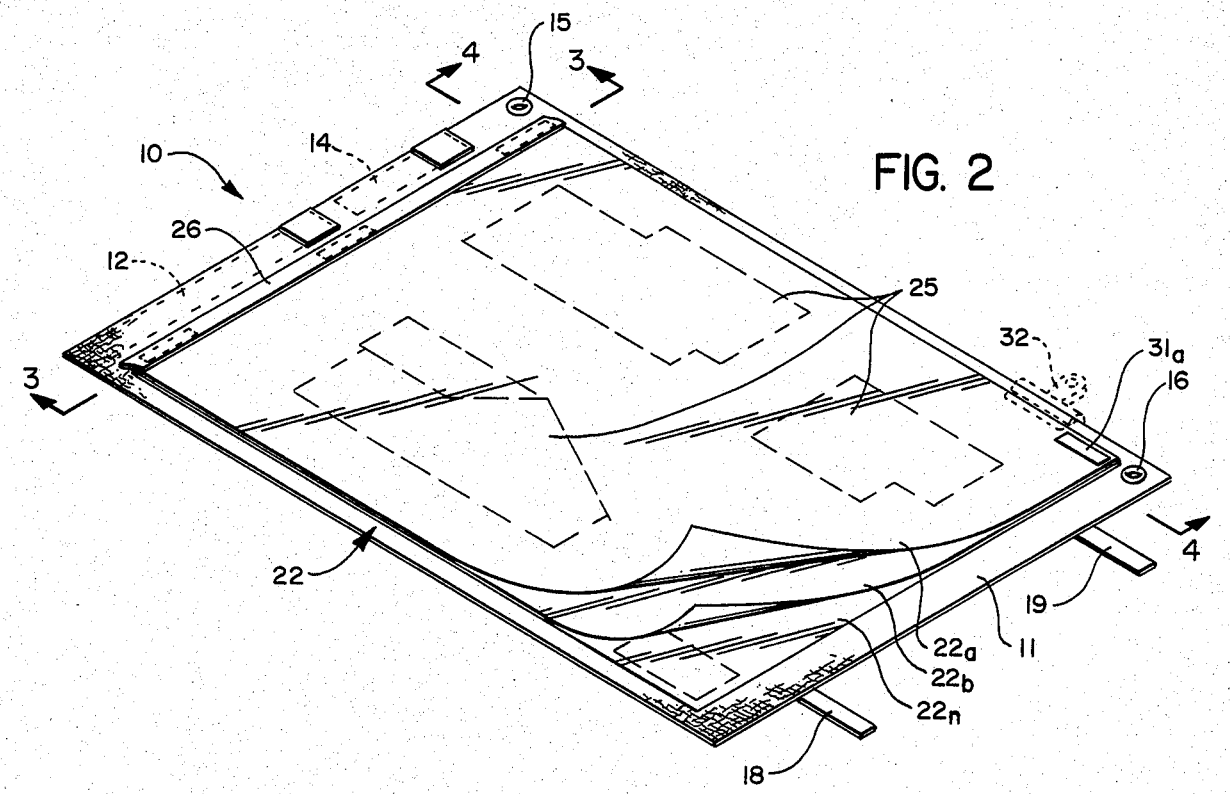
FIG. 2 is a perspective view of the storage device shown in FIG. 1, here illustrating the device in an unrolled condition and illustrating a plurality of construction drawings or the like disposed in individual transparent watertight envelopes so as to permit of reference to the envelope contents under inclement and/or adverse environmental conditions without subjecting the plans, charts or other documents to potential damage due to such adverse conditions and, illustrating also, alternative approaches for retaining the envelopes in flat face-to-face relation to one another and/or to the rollable fabric backing member.

Turning now to the drawings, a portable, weathertight storage and visible display device, generally indicated at 10, embodying features of the present invention has been illustrated in a rolled-up tubular helical configuration in FIG. 1 and in an unrolled planar document display condition in FIG. 2. As best shown in FIG. 2, the device 10 preferably includes: (i) a canvas, tarpaulin or similar fabric material backing member 11 in rectilinear sheet-like form; (ii) a pair of pockets 12, 14 formed along one edge of the backing member 11 for reception and storage of rulers, grease pencils and/or similar drawing implements (not shown); (iii) a pair of grommets 15, 16 at the upper corners of the backing member 11 for permitting the storage/display device 10 to be hung or otherwise suspended from hooks on a vertical backboard or work easel (not shown); and (iv), a pair of laterally projecting straps 18, 19 which are preferably formed of a conventional fabric-type fastener having mating male and female projections on the opposite faces thereof. Thus, the arrangement is such that when the backing member 11 is rolled into a tubular helix as shown in FIG. 1, one facing surface of each strap 18, 19—e.g., the upper face as viewed in FIG. 2—overlaps the opposite face of the respective strap when in a rolled configuration, permitting the straps 18, 19 to function as separable fabric fastening devices for retaining the fabric backing member and the drawings, charts or other documents carried thereby in a compact, tightly rolled helical configuration as shown in FIG. 1. If desired, a web-like or other fabric strap 20 may be stitched or otherwise secured to the backing member 11 along one edge thereof so as to provide a carrying handle 21 for the rolled-up device as best shown in FIG. 1.

In carrying out the present invention, n transparent document receiving envelopes $22_a$–$22_n$ are removably mounted on the fabric backing member 11 for visibly displaying the front and reverse sides of a document printed on both sides or a pair of back-to-back documents captively retained within each envelope in a protected weathertight environment. In its broader aspects, the invention contemplates that "2" or more of such envelopes are provided and, in the illustrative form of the invention, three such envelopes $22_a$, $22_b$ and $22_n$ are provided. To facilitate an understanding of the invention, those skilled in the art will appreciate that each envelope 22 is, in effect, a relatively large "freezer bag" or "sandwich bag" of the type formed of a relatively heavy gauge transparent plastic material such as polyethylene, polyvinylchloride, or the like with a separable fastener extending along one lateral edge of the envelope 22 such, merely by way of example, as a ZIP-LOC® (ZIP-LOC is a registered trademark of The Dow Chemical Company) fastener 24 as diagrammatically shown in FIG. 4. By "relatively large" it will be understood that the transparent envelopes $22_a$–$22_n$ are sized to easily accommodate and fully display at least one blueprint, drawing, chart or the like which may, for example, comprise a standard "A"-sized, "B"-sized or "C"-sized drawing or the like; or, for that matter, to accommodate non-standardized drawings or charts of any size. Consequently, it will be understood that the particular dimensions employed may vary widely dependent upon the size of the document(s) to be stored and/or displayed; and, as such, are not critical to the present invention.

Thus, the arrangement is such that a document such, for example, as a construction drawing shown diagrammatically in broken lines at 25 in FIG. 2, or a pair of back-to-back documents (not shown), can be introduced into each envelope $22_a$–$22_n$, sealed therein by closure of the edge fastener 24 (FIG. 4), and retained therein in a protected weathertight environment permitting field inspection, reference to and/or annotation of any given document through the transparent envelope(s) $22_a$–$22_n$ without subjecting the document itself to adverse weather and/or other destructive environmental conditions.

Figure 3:
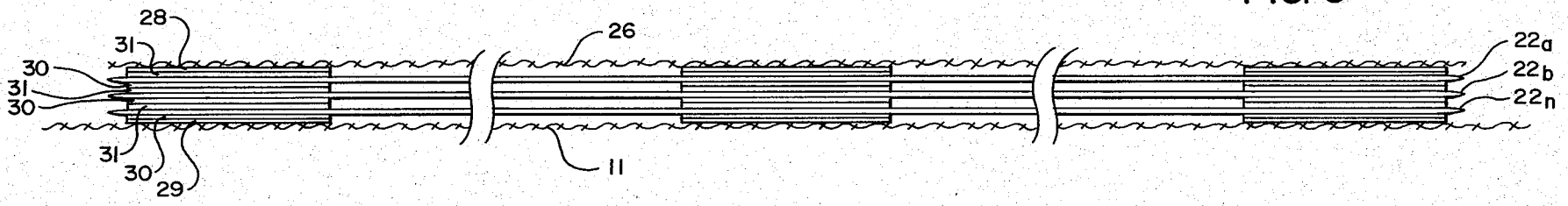
FIG. 3 is a sectional view taken substantially along the line 3—3 in FIG. 2 and here illustrating a convenient manner for removably mounting a plurality of document-containing watertight envelopes within an outer rollable container formed of tarpaulin or other suitable fabric material; and, FIG. 4 is a sectional view taken substantially along the line 4—4 in FIG. 2 and illustrating particularly details of the plurality of watertight transparent envelopes employed for storing documents such as construction plans, charts or the like in a manner rendering such documents visible and accessible but wherein they are protected at all times from inclement weather conditions.

In keeping with the invention, provision is made for removably mounting the envelope(s) $22_a$–$22_n$ on the fabric backing member 11 in such a manner that either face of any given envelope can be exposed and/or so that a plurality of envelopes can be reordered to position any selected envelope on top of a stack of envelopes for display of the document contained in that envelope in protected condition; yet, wherein all of the document containing envelope(s) $22_a$–$22_n$ and the fabric backing member 11 comprise a unitary flexible book-like storage and display package in which each envelope $22_{a-22n}$ comprises, in effect, a separate "page" wherein either face can be displayed. In the illustrative form of the invention, and as best illustrated by reference to FIGS. 2–4 conjointly, this is accomplished by providing the fabric backing member 11 with an integral fabric flap 26 disposed adjacent one edge of the backing member 11—for example, adjacent the left edge thereof as viewed in FIG. 2 and located immediately adjacent to and to the right of the pockets 12, 14. Separable and cooperable fabric fastening members which are completely conventional in construction are mounted on the undersurface of the flap 26 as indicated at 28 (FIG. 4), and on the upper surface of the backing member 11 as indicated at 29—it being understood that either fastening element 28 or 29 would comprise the male fastener component while the other would comprise the female component. For convenience, as the ensuing description proceeds it will be assumed that element 28 on the undersurface of flap 26 comprises the male fastener, while element 29 comprises a female fastener. Each envelope $22_a$–$22_n$ is similarly provided with cooperable fabric male and female fastener elements 30, 31 disposed along one edge thereof; and, under the assumed illustrative conditions, it will be noted that each envelope includes female fabric fastener elements 31 along its left upper edge positioned to be selectively engaged with either the male fastener elements 28 on the undersurface of the fabric flap 26 or with corresponding male fastener elements 30 on the lower surface of the left edge of an overlying envelope.

Figure 4:
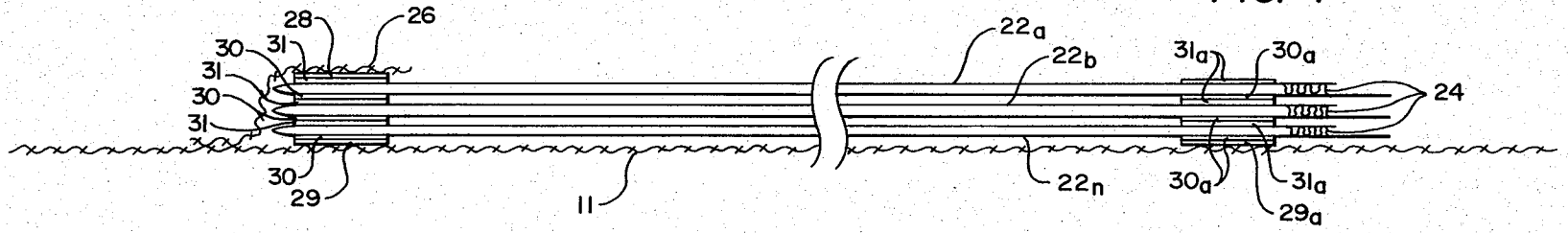

For example, and as best shown in FIG. 4, it will be observed that the fabric female fastener elements 31 on the upper envelope $22_a$ are separably engaged with male fastener elements 28 on the undersurface of flap 26; the female fastener elements 31 on the upper left edge of the intermediate envelope $22_b$ are similarly separably engaged with the male fastener elements 30 on the lower left edge of the upper envelope $22_a$; the female fastener elements 31 on the upper left edge of the lowermost envelope $22_n$ are separably engaged with the male fastener elements 30 on the lower left edge of the intermediate envelope $22_b$; and, the male fastener elements 30 on the lower left edge of the lowermost envelope $22_n$ are separably engaged with a female fastener elements 29 on the fabric backing member 11. Thus, all of the envelopes $22_a$–$22_n$ are securely retained captive between the fabric flap 26 and fabric backing member 11 with freedom for the envelopes to be overturned about their left edges in much the fashion of the pages of a book so as to expose the undersurface of any given envelope and/or the upper surface of any given underlying envelope. And, of course, if the user wishes to reorder the envelopes $22_a$–$22_n$, this may be readily accomplished by the simple expedient of separating the mated fabric fasteners, changing the envelope order—for example, positioning the uppermost envelope $22_a$ on the bottom of the stack so as to expose the upper face of envelope $22_b$—and reassembling the fabric fasteners in the manner described above.

However, while the use of conventional fabric-type fasteners has proven highly desirable and has resulted in a highly effective, reliable and versatile portable weathertight storage and display device 10, those skilled in the art will appreciate that a wide variety of other releasable fastening means can be employed without departing from the spirit and scope of the invention as expressed in the appended claims. For example, one end of each envelope can be provided with integral plastic or metallic cooperable snap elements (male on one face and female on the other); or, alternatively, plastic or metallic grommets can be integrally formed along one edge of each envelope for separable mounting on ring-type, post or similar conventional fastening devices integral with the fabric backing member 11.

In carrying out the present invention, provision is made for releasably securing the opposite edge of each envelope $22_a$–$22_n$—e.g., the right edge of each envelope as viewed in FIG. 2—or, at least, one corner of each envelope opposite edge, to the fabric backing member 11 so that the portable storage/display device 10 can be readily hung or suspended by the grommets 15, 16 from hooks on any suitable vertically oriented work surface or easel. To accomplish this, the illustrative form of the invention depicted in the drawings contemplates the use of separable fabric fasteners $30_a$–$31_a$ on the opposite faces of each envelope adjacent the upper right corner thereof and which are positioned to be separably engaged with the complementary fastener formed on the undersurface of overlying envelopes and the upper surface of underlying envelopes or a fabric fastener $29_a$ secured to the fabric backing member 11. While such an arrangement has proved highly effective when displaying protected documents, it has been observed that such fasteners, when operatively associated with one another at the free ends of a plurality of envelopes, tend to interfere with rolling up of assembled envelopes and a fabric backing member since they preclude relative sliding movement of the overlying envelopes during a rolling operation. Such problem may be resolved in a number of ways. For example, the portable storage/display device 10 may include a series of single sided male or female fabric fasteners (not shown) normally stowed within one of the pockets 12, 14 when the device 10 is oriented in a document display mode; but, which can be interposed between the cooperable mating fastener elements $30_a$, $31_a$ or $30_a$, $29_a$ and separably attached to an appropriate one of the cooperable fabric fasteners $29_a$, $30_a$, $31_a$ for preventing meshed interengagement thereof during rolling up of the device preparatory to a storage or portable transport mode. Alternatively, the right-hand fabric fasteners $29_a$–$31_a$ (FIG. 4) may be dispensed with altogether and a suitable pressure clamp, diagrammatically illustrated at 32 in FIG. 2, may be employed during the document display mode for fixedly securing the envelopes $22_a$–$22_n$ to the backing member 11.

Although not shown in the drawings, it will be understood that provision can be made for retaining overturned envelopes in their overturned position exposing an underlying envelope even when the device 10 is supported from a vertically oriented work surface. Thus, the work surface may itself incorporate a fabric fastener which can be engaged with the uppermost corner fastener $31_a$ (FIGS. 2 and 4) on envelope $22_a$. Alternatively, the envelope(s) may be provided with integral grommets suitable for engagement with a hook (not shown) on the work surface. In either case, the overturned envelope(s) will be retained in their overturned position so as to fully expose the reverse side of the lowermost overturned envelope and the upper side of the underlying envelope.

Thus, those skilled in the art will appreciate that there has herein been described a simple, yet highly effective storage/display device 10 characterized by its simplicity, versatility, and effectiveness in storing documents within protected weathertight containers and which may be easily rolled up into a compact, portable, tubular helix for compact storage and/or transport between points of storage and points of use. Because the paper documents are totally contained within sealed containers or envelopes $22_a$–$22_n$ at all times, they are effectively protected from inclement weather conditions and/or other destructive environmental conditions; yet, because the envelopes are formed of transparent plastic material, the documents may be readily viewed, inspected and/or annotated without having to remove them from their sealed protected state.

It will, of course, also be understood that the interengageable male/female fasteners—e.g., the fasteners 28–31 and $29_a$–$31_a$—may vary widely in size, type and/or material. Commonly such fasteners are formed of fabrics, including natural, synthetic and/or blends of fibrous materials. However, such fasteners can also be formed of plastic materials. Therefore, the phrase "fabric fastener(s)" as used herein and in the appended claims has been used in a non-limiting sense and is intended to embrace all equivalent fastener types. And, as previously indicated, other types of conventional fasteners—e.g., clamps, ring-type, post-type, etc.—may also be employed.

What is claimed is:

1. A compact, portable, weathertight document storage and visible display device comprising, in combination:

(a) a rectilinear fabric backing member capable of being rolled into and unrolled from a tubular helix;

(b) a plurality of rectilinear envelopes each formed of transparent liquid impervious synthetic flexible sheet material and each being transparent both front and back;

(c) first means for releasably securing said plurality of envelopes to said fabric backing member in overlying relation thereto along a first edge of each of said envelopes with said envelope first edges disposed in vertically stacked overlying relation one to another;

(d) second means for releasably securing said plurality of envelopes to said fabric backing member along at least a portion of an envelope edge remote from said first edge; and, (e) said plurality of envelopes each having a resealable access opening along an edge thereof for permitting introduction and/or removal of a document and/or two back-to-back documents into and from the interior thereof and selective retention of such document(s) in weathertight protected condition within each envelope interior while permitting viewing of a document through the transparent sheet material defining both the front and back of said envelope;

whereby said fabric backing member and said plurality of envelopes can be rolled tightly into a tubular helix with said plurality of envelopes totally closed within said helically rolled fabric backing member when not in use and permitting unrolling of said fabric backing member and said plurality of envelopes into a planar configuration for display of and reference to protected document(s) contained therein, and wherein said second releasable securing means can be released to permit overturning of the uppermost envelope(s) about said first edge for displaying any document visible from the reverse side of said uppermost overturned envelope and/or any document visible in the uppermost one of any underlying envelope.

2. A portable, weathertight document storage and visible display device as set forth in claim 1 wherein said fabric backing member is formed of canvas.

3. A portable, weathertight document storage and visible display device as set forth in claim 1 further including pocket defining means for reception and storage of drawing implements.

4. A portable, weathertight document storage and visible display device as set forth in claim 1 further including strap defining means secured to said backing member and projecting laterally from one edge thereof for securing said backing member, plurality of envelopes and document(s) in a tightly rolled tubular helix when not in use.

5. A portable, weathertight document storage and visible display device as set forth in claim 4 wherein said strap defining means comprise flexible fabric fastening means having interengageable male fastening hooks on one face thereof and female fastening elements on the opposite face thereof.

6. A portable, weathertight document storage and visible display device as set forth in claim 4 further including a carrying handle secured to said fabric backing member along one edge thereof and positioned to extend lengthwise along the outer surface of said tightly rolled tubular helix.

7. A portable, weathertight document storage and visible display device as set forth in claim 1 wherein said first means for releasably securing said plurality of envelopes comprises:

(i) a flap integral with said fabric backing member and disposed along and overlying an edge portion thereof;

(ii) first flexible fabric means formed on the underside of said flap;

(iii) second flexible fabric fastening means formed on said backing member and disposed beneath said first flexible fabric fastening means;

(iv) first flexible fabric fastening means secured to the underside of each of said plurality of envelopes along one edge thereof and positioned to overlie said second flexible fabric fastening means; and, (v) second flexible fabric fastening means secured to the upper side of each of said plurality of envelopes along said one edge thereof and positioned to underlie said first named first flexible fabric fastening means;

said first flexible fabric fastening means comprising one of male or female fastening elements and said second flexible fabric fastening means comprising the other of male or female fastening elements.

8. A portable, weathertight document storage and visible display device as set forth in claim 1 wherein said second means for releasably securing said plurality of envelopes to said fabric backing member comprises mutually engageable male and female fabric fastener elements, there being at least one male element disposed on one side of each of said plurality of envelopes and at least one female element disposed on the opposite side thereof with all male elements disposed on either the upper side(s) or the lower side(s) of said plurality of envelopes; and, a fabric fastener element secured to said backing member in a position and of a male/female type selected to mesh and interengage with the fabric fastener element on the underside of the immediately superimposed one of said plurality of envelopes.

9. A portable, weathertight document storage and visible display device as set forth in claim 7 wherein said second means for releasably securing said plurality of envelopes to said fabric backing member comprises mutually engageable male and female fabric fastener elements, there being at least one male element disposed on one side of each of said plurality of envelopes and at least one female element disposed on the opposite side thereof with all male elements disposed on either the upper side(s) or the lower side(s) of said plurality of envelopes; and, a fabric fastener element secured to said backing member in a position and of a male/female type selected to mesh and interengage with the fabric fastener element on the underside of the immediately superimposed one of said plurality of envelopes.

10. A portable, weathertight document storage and visible display device as set forth in claim 1 wherein said second means for releasably securing said plurality of envelopes to said fabric backing member comprises compressible clamp means.

11. A portable, weathertight document storage and visible display device as set forth in claim 7 wherein said second means for releasably securing said plurality of envelopes to said fabric backing member comprises compressible clamp means.

* * * * *